US009227213B2

(12) United States Patent
Bloc et al.

(10) Patent No.: US 9,227,213 B2
(45) Date of Patent: Jan. 5, 2016

(54) PUSH BUTTON FOR A PRESSURISED-PRODUCT DISPENSING SYSTEM

(75) Inventors: Richard René Bloc, Derchigny-Graincourt (FR); Emmanuel Mauduit, Eu (FR); Thomas Roosel, Notre Dame d'Aliermont (FR)

(73) Assignee: ALBÉA LE TREPORT S.A.S. (FR)

( * ) Notice: Subject to any disclaimer, the term of this patent is extended or adjusted under 35 U.S.C. 154(b) by 617 days.

(21) Appl. No.: 13/543,525

(22) Filed: Jul. 6, 2012

(65) Prior Publication Data

US 2013/0008981 A1 Jan. 10, 2013

(30) Foreign Application Priority Data

Jul. 6, 2011 (FR) ..... 11 56130

(51) Int. Cl.

| | |
|---|---|
| ***B05B 7/32*** | (2006.01) |
| ***B05B 11/00*** | (2006.01) |
| ***B05B 1/00*** | (2006.01) |
| ***B05B 1/34*** | (2006.01) |
| ***B05B 1/32*** | (2006.01) |
| ***B05B 1/30*** | (2006.01) |

(52) U.S. Cl.

CPC ..... *B05B 11/3053* (2013.01); *B05B 1/00* (2013.01); *B05B 1/3073* (2013.01); *B05B 1/323* (2013.01); *B05B 1/34* (2013.01); *B05B 11/0005* (2013.01); *B05B 11/3047* (2013.01); *Y10T 29/49412* (2015.01)

(58) Field of Classification Search

CPC ..... B65D 83/20; B65D 83/14; B65D 83/48; B65D 83/38; B05B 1/3073; B05B 1/323; B05B 1/00; B05B 1/34; B05B 11/3053; B05B 11/005; B05B 11/3047; Y10T 29/49412

USPC ..... 239/451, 453, 337, 1, 11; 222/402.1

See application file for complete search history.

(56) References Cited

U.S. PATENT DOCUMENTS 5,127,579 A * 7/1992 Tempelman ..... 239/337
8,328,120 B2 * 12/2012 Vanblaere et al. ..... 239/337

FOREIGN PATENT DOCUMENTS

FR 2948343 A1 1/2011

OTHER PUBLICATIONS

French Search Report; Application No. FR 1156130; Issued: Feb. 20, 2012; 6 pages.

* cited by examiner

*Primary Examiner* — Steven J Ganey

(74) *Attorney, Agent, or Firm* — St Onge Steward Johnston and Reens LLC

(57) ABSTRACT

A push button for a pressurised-product dispensing system, including an actuation body having an orifice for ejecting the product, a needle closing off the ejection orifice and a sleeve having a mounting well, the body being mounted to slide about the sleeve between high and low positions, forming between them a sealed space for conveying the product, the needle being associated with the sleeve by a link rotatably mounted on the sleeve to actuate the reversible movement of the needle between a closure position—or respectively an open position—of the ejection orifice when the body is in the high position—or respectively in the low position—, the needle provided with geometric means that interact with the body to exert a force holding the needle in a mounting position in which the needle projects from the body to enable the link to be associated with the needle.

20 Claims, 4 Drawing Sheets

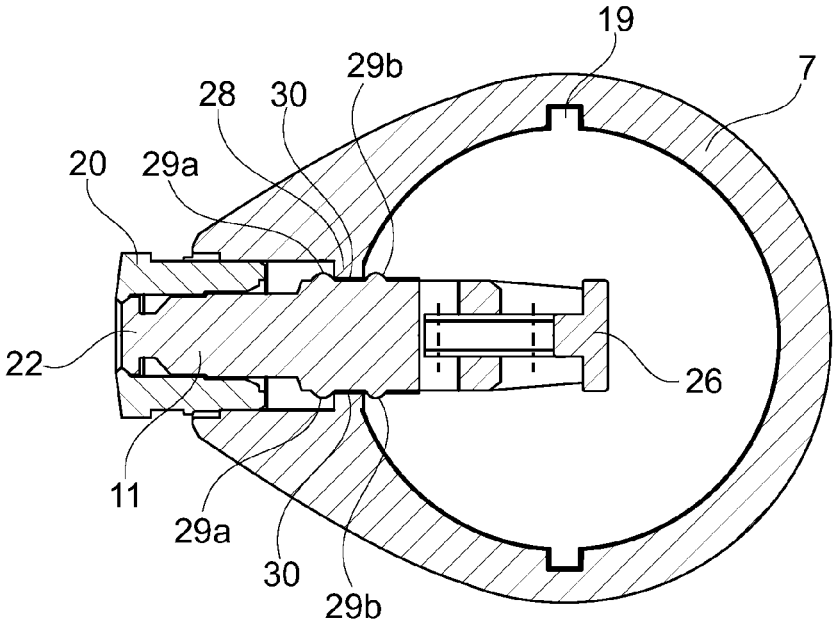
Fig. 6B
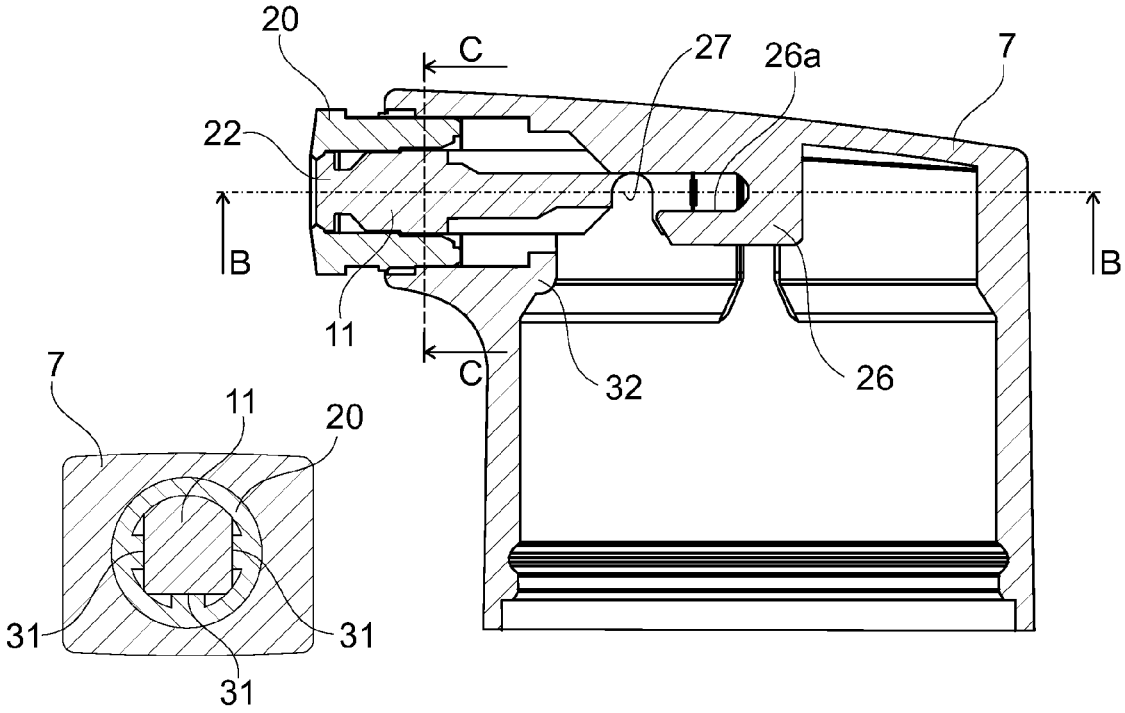
Fig. 6C
Fig. 6A

PUSH BUTTON FOR A PRESSURISED-PRODUCT DISPENSING SYSTEM

CROSS-REFERENCE TO RELATED APPLICATIONS

The present application claims priority of French patent application Ser. No. 11/56,130 filed on Jul. 6, 2011, the content of which is incorporated herein by reference.

FIELD OF THE INVENTION

The invention concerns a push button for a pressurised-product dispensing system and a method of assembling such a push button. The invention also concerns a dispensing system comprising a pump actuated by such a push button as well as a bottle containing a product to be dispensed under pressure by means of such a dispensing system.

BACKGROUND OF THE INVENTION

In a particular application, the product is of the gel or cream type, for example for use in cosmetics or for pharmaceutical treatments.

Dispensing systems are known comprising a pump provided with a tube for feeding the product under pressure on which a push button is fixed in order to actuate the movement of said tube over a product-dispensing/aspiration travel.

In particular, the push button may comprise an actuation body having a product-ejection orifice and a sleeve having a well for mounting said push button on the feed tube of the pump. Thus, while pressing on the body of the push button, the pump is actuated in order to dispense the product in the form of a blob or a continuous stream.

Dispensing systems may be equipped with a means for reversible closure of the ejection orifice between two dispensings, in order to limit contacts between the external air and the product standing in the pump, in particular in order to avoid drying and/or degradation of said product over time.

To do this, the use of an elastically deformable valve is known, on which a movable lip is formed by applying the dispensing pressure to it. Reversible closure can then be obtained by arranging the valve on the body, with said lip in sealed contact in the ejection orifice, the movement of said lip opening said orifice.

However, the valves, which are components moulded separately and then attached to the body, have the drawback of low mechanical strength, that is to say they are sometimes carried away by the stream of product. In addition, in high-rate industrial productions, they are difficult to place on the body, since they consist of a material that is flexible and therefore often adherent to the walls of the feed chutes and the gripping members of the assembly machines.

According to another known embodiment, reversible closure can be obtained by means of a needle closing off the ejection orifice, said needle being movable between its positions of closing and opening said orifice over the actuation travel of the push button, in particular at the start of this travel. This embodiment has in particular the advantage of mechanically opening the ejection orifice without the product being pressurised to do this.

A push button is known from the document FR-2 948 343, comprising a needle closing the ejection orifice, in which the actuation body is slidably mounted about the sleeve between a high position and a low position forming between them a space for conveying the product from the mounting well to the ejection orifice. The needle is mounted between the body and the sleeve by means of a device for reversible movement between a closure position—or respectively an open position—when the body is in the high position—or respectively in the low position—, said push button also comprising a means of elastic return of the body to the high position.

In the embodiment described in this document, the elastic return means is formed by discontinuous lugs that extend between two rings of a member that is attached to the sleeve. Thus the sealing of the conveying space is achieved by sealed sliding of the sleeve in the body, which requires a dynamic seal that proves to be difficult to reproduce and may give rise to unpleasant friction in use.

In addition, the assembly of the five parts of the push button described in the document FR-2 948 343 proves to be difficult to implement at the rates imposed by the field of application.

SUMMARY OF THE INVENTION

The invention aims to improve the implementation of the push buttons provided with a needle closing off the ejection orifice by proposing in particular a design that is easy to assemble, in particular comprising only four parts, and in which in addition the sealing of the conveying space can be achieved statically.

The invention proposes in particular a closure seal that is improved so as to be able to dispense products with a high sensitivity to air. Consequently the combined use of a dispensing system according to the invention with a bottle containing a product sensitive to air is particularly advantageous.

In particular, sensitive to air means products containing a solvent liable to evaporate quickly, for example based on alcohol or water, or containing photosensitive substances, for example sun filters, or ones that are easily oxidisable, for example vitamins, in particular vitamin C.

Moreover, the functioning of the dispensing system according to the invention limits the pressurisation of the product during dispensing. Thus the combined use of a dispensing system according to the invention with a bottle containing a product sensitive to mechanical forces is also particularly advantageous.

In particular, sensitive to mechanical forces means products, for example creams, liable to undergo a physicochemical transformation under pressure, in particular a phase separation or change.

The dispensing system according to the invention also advantageously enables products that are particularly viscous and/or sensitive to external contamination, in particular microbial, to be dispensed.

To achieve these various improvements, according to a first aspect, the invention proposes a push button for a pressurised-product dispensing system, said push button comprising an actuation body having a product-ejection orifice, a needle closing off the ejection orifice and a sleeve having a well for mounting said push button on a pressurised-product feed tube, said body being mounted so as to slide about said sleeve between a high position and a low position, forming between them a sealed space for conveying the product from said mounting well to said ejection orifice, the needle being associated with the sleeve by means of a link that is mounted so as to rotate on said sleeve in order to actuate the reversible movement of said needle between a closure position—or respectively an open position—of the ejection orifice when the body is in the high position—or respectively in the low position—, the needle being provided with geometric means that interact with the body in order to exert a force holding said needle in a mounting position in which said needle projects from the body to enable the link to be associated with said needle.

According to a second aspect, the invention proposes a method of assembling such a push button, said method providing the steps of:

placing the needle in the mounting position;

sliding the sleeve in the body, said sliding being arranged so as to enable the link to be associated with the needle;

placing the needle in the operational position.

According to a third aspect, the invention proposes a pressurised-product dispensing system comprising a pump actuated by such a push button, said pump comprising a pressurised-product feed tube on which the well for mounting said push button is fixed.

According to a fourth aspect, the invention proposes a bottle containing a product to be dispensed under pressure, said bottle comprising a collar on which such a dispensing system is associated so as to put the pump in communication with a product to enable the product to be conveyed from the feed tube to the ejection orifice.

BRIEF DESCRIPTION OF THE DRAWINGS

Other objects and advantages of the invention will emerge in the following description given with reference to the accompanying figures, in which:

FIGS. 6A to 6C are views showing the arrangement of the needle in the mounting position, respectively in longitudinal section (FIG. 6A), in section BB in FIG. 6A (FIG. 6B) and in section CC in FIG. 6A (FIG. 6C).

DETAILED DESCRIPTION OF THE INVENTION

Figure 1:
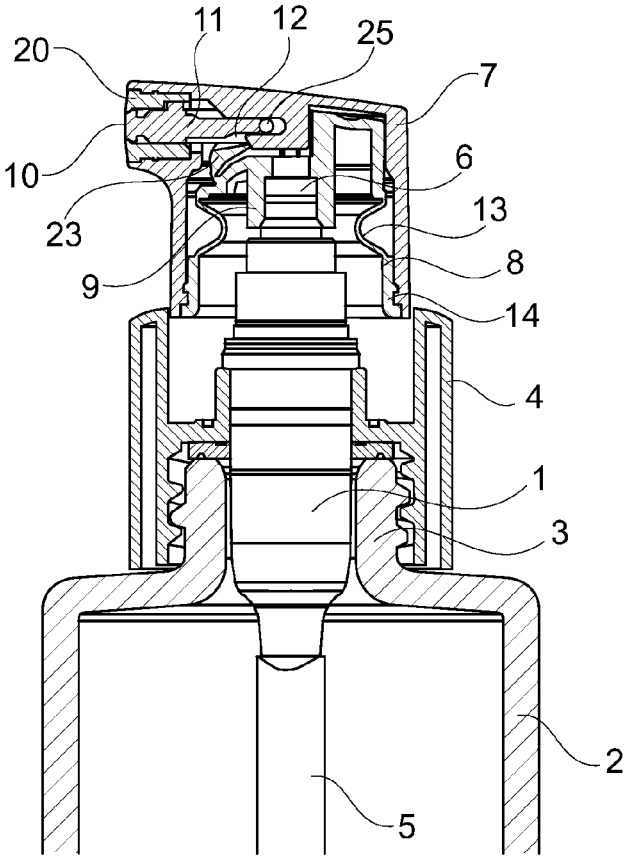
FIG. 1 is a partial view in longitudinal section of a bottle equipped with a dispensing system according to one embodiment of the invention, in which the needle is in the position of closing off the ejection orifice.

In the description, the terms for positioning in space are taken with reference to the position of the bottle shown in FIG. 1.

In relation to the figures, an embodiment of a dispensing system is described, comprising a pump 1 actuated by a push button to enable a pressurised product to be dispensed, for example in the form of a blob or a continuous stream.

To do this, the dispensing system is mounted on a bottle containing the product to be dispensed under pressure. In an example application, the product is a gel or a cream, for cosmetic use or for pharmaceutical treatments.

In the embodiment shown, the bottle comprises a body 2 with a collar 3 above it and the dispensing system comprises a hoop 4 on which the pump 1 is mounted, said hoop being associated with the collar 3 so as to put the pump 1 in sealed communication with the product.

In relation to FIG. 1, with the pump 1 not in cross section, the invention is not limited to a particular pump structure, in particular in relation to the means necessary for pressurising the product to be dispensed. In particular, the dispensing can be carried out with or without the take-up of air in a bottle body 2, which may be rigid or flexible.

In the embodiment shown, the pump 1 comprises a plunger tube 5 arranged in the body 2 of the bottle to supply said pump with product and a tube 6 for feeding the product pressurised by said pump, the means necessary for pressurising the product to be dispensed being interposed between said plunger tube and said feed tube. In a variant, the pump 1 can be fed by means of a piston mounted slidably in the body 2 of the bottle.

The feed tube 6 is movable over a product dispensing/aspiration travel, said movement being conventionally constrained by an elastic return means. To actuate this movement, the push button is mounted on the downstream part of the feed tube 6, said push button comprising an actuation body 7 and a sleeve 8 having a well 9 for mounting said push button on said feed tube. Thus, by fixing the mounting well 9 on the feed tube 6, the product is dispensed by pressing on the body 7 in order to actuate the movement of said tube by means of the sleeve 8.

The actuation body 7 has a product-ejection orifice 10, said orifice being equipped with an obturation needle 11 to allow the reversible closure of said orifice between two uses. The embodiment described in particular ensures good sealing in a simple fashion while limiting the pressure exerted on the product to open the orifice 10.

Figure 2A:
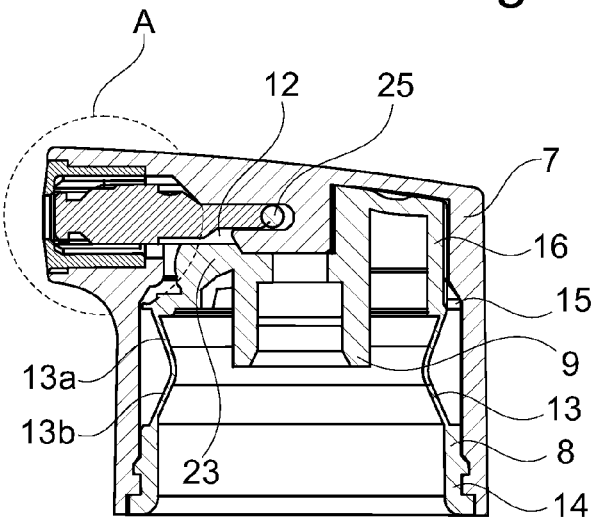
FIG. 2A is a view in longitudinal section of the push button shown in FIG. 1, in which the needle is in the position of opening the ejection orifice.
Figure 2B:
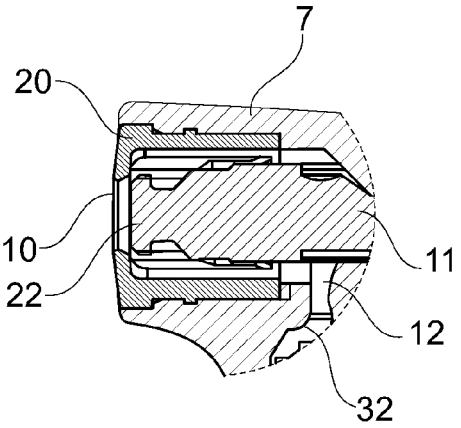
FIG. 2B is an enlarged view of area A in FIG. 2A.

The body 7 is slidably mounted about the sleeve 8 between a high position (FIG. 1) and a low position (FIG. 2A), forming between them a sealed space 12 for conveying the product from the mounting well 9 to the ejection orifice 10. Thus the mounting of the dispensing system on the bottle enables the product to be conveyed from the bottle to the ejection orifice 10 by means of the feed tube 6 and then the space 12.

The push button comprises a bellows 13 having a top edge secured to the sleeve 8 and a bottom edge secured to the actuation body 7, said bellows being, by sliding of said body about said sleeve, elastically deformable to a constrained state of returning said body to the high position. Thus, in the absence of pressing on the body 7, the latter is in the high position of closure of the ejection orifice 10. In a variant that is not shown, the dispensing system can comprise another type of means of elastic return of the body 7 to the high position, optionally in addition to the bellows 13.

According to one embodiment, the force exerted by the return means of the feed tube 6 may be greater than the force exerted by the bellows 13 so that pressing on the body 7 causes first of all a movement of said body with respect to the sleeve 8 in order to open the ejection orifice 10 and then a movement of the sleeve 8 and therefore of the feed tube 6 in order to actuate the pump 1.

In the embodiment shown, the bellows 13 is made in one piece with the sleeve 8, the bottom end of said bellows has a collar 14 that is fixed sealingly to the actuation body 7. Advantageously, the sleeve 8, the bellows 13 and the collar 14 can form a single piece produced, in particular by moulding, for example from a material with shape memory in order to exert the required elastic return force. In example embodiments, the material used may be an elastomeric polymer such as polyoxymethylene or polypropylene of the Adflex type.

Figure 3:
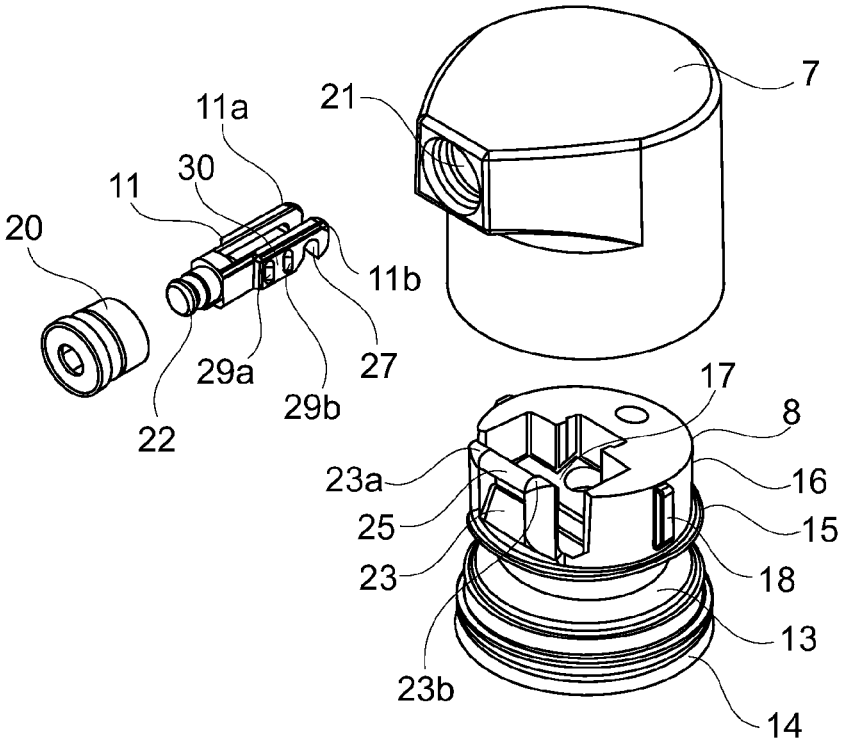
FIG. 3 is a view in exploded perspective of the parts forming the push button in FIG. 2A.
Figure 4:
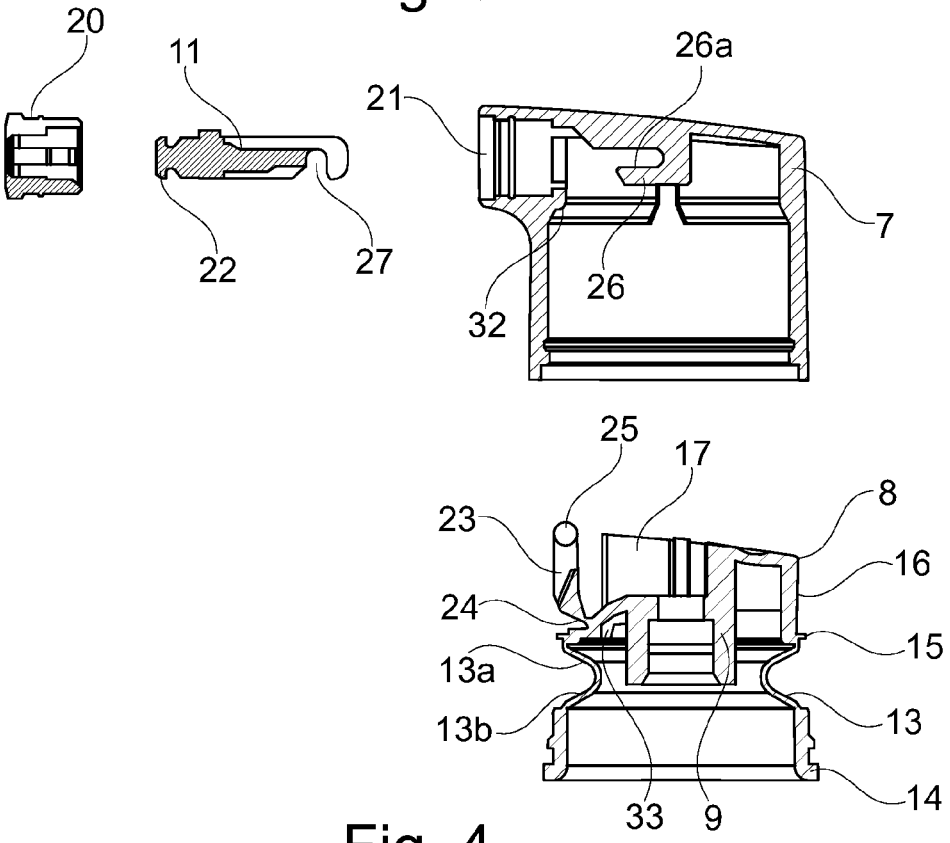
FIG. 4 is a view in longitudinal section of the parts in FIG. 3.

This embodiment, by including in the sleeve 13 the elastic return means of the body 7, makes it possible to limit to four the number of components to be assembled (FIG. 3) so as to facilitate said assembly. In addition, the reproducibility of the performance relating to the closure function of the ejection orifice 10 is also improved thereby.

The bellows 13 extends continuously around the mounting well 9, sealingly delimiting part of the conveying space 12 around said bellows. Thus the sealing of the conveying space 12 is achieved statically between the collar 14 and the body 7. In particular, the conveying space 12 is formed essentially around the bellows 13 and under the top part of the body 7, while being delimited by the top face of the sleeve 8, the closure needle 11 being placed in said space.

In the embodiment shown, the bellows 13 has a top annular fold 13*a* that extends internally and a bottom annular fold 13*b* that extends externally, said folds being movable axially between an initial state (FIG. 1) and a constrained separated state (FIG. 2A) to allow the return of the actuation body by elastic return of said folds into the initial state.

In order to guide the sliding of the body 7, the sleeve comprises a projecting external ring 15 that is mounted in an axial length of the actuation body 7. In addition, the sleeve 8 has a top external wall 16 that is mounted in an axial length of the body 7.

The external wall 16 shown extends angularly over more than 180°, having a recess 17 open towards the front and upwards in which the mounting well 9 emerges, part of the conveying space 12 being formed in said recess. Moreover, the ring 15 extends annularly below the external wall 16, said ring and said wall being mounted with friction in the actuation body 7.

The external wall 16 and the axial length of the body 7 have geometric means for limiting their relative swivelling during sliding. In the embodiment shown, the external wall 16 has two axial knurls 18 that are diametrically opposed, the axial length having two grooves 19 in which respectively a knurl 18 is slidably placed.

The needle 11 is mounted so as to be reversibly movable between the body 7 and the sleeve 8 between a closure position—or respectively an open position—of the ejection orifice 10 when the body 7 is in the high position—or respectively in the low position.

In the embodiment shown, the push button also comprises an end piece 20 that is mounted on the actuation body 7, said end piece having the ejection orifice 10 and the needle 11 being mounted in translation with respect to said end piece between its closure and open positions. More precisely, the end piece 20 has a skirt for fitting in a housing 21 of the body 7 and a front wall pierced with the ejection orifice 10.

The needle 11 has front end comprising a closure head 22, said head being slidably mounted in the skirt of the end piece 20, the front wall forming a sealed seat for said head in the closure position.

The end piece 20 can be produced from a hard rigid material such as a polyoxymethylene (POM) and the needle 11 from a more flexible and ductile material such as a high-density polyethylene (HDPE). According to one embodiment, at least the closure head 22 and/or the seat of the end piece 20 can contain an antibacterial agent, for example based on silver, such as Alphasan or Batiglas, in order to prevent the penetration of microorganisms through the film of product gripped between said head and said seat.

The rear end of the needle 11 is associated with the sleeve 8 by means of a link 23 that is mounted for rotation on said sleeve. More precisely, the link 23 is mounted for rotation at the front of the recess 17 by means of a hinge 24, said link carrying a spindle 25 opposite said hinge. In particular, the link 23 can be made in one piece with the sleeve 8, for example by producing a thinned area forming the hinge 24 at the base of the link 23.

The body 7 comprises a hook 26 for actuating the rotation of the link 23 about the hinge 24 when said body slides, said hook being integrated under said body in the conveying space 12. The hook 26 forms a runner 26*a* in which the spindle 25 of the link 23 is mounted so as to be able to move in translation by rotation of said link when the body 7 slides. In addition, the needle 11 comprises at least one notch 27 in which the spindle 25 is placed in order to fix said needle to said spindle. This embodiment makes it possible to convert the axial sliding of the body 7 into a substantially radial translation of the needle 11 between closure and opening positions.

The needle 11 comprises two rear flanks 11*a*, 11*b* on each of which a notch 27 is formed, the link 23 having two arms 23*a*, 23*b* between which the spindle 25 extends. In addition, the link 23 is inclined internally in the recess 17 so that an axial abutment on the spindle 25 by means of the hook 26 causes a folding of said link in said recess and therefore a sliding of said spindle in the runner 26*a*.

Moreover, in order to define the end of travel of the sliding of the body 7, the hook 26 forms an internal stop that is in abutment on the bottom of the recess 17 when the body 7 is in the bottom position. Thus the actuation force of the pump 1 is transmitted at this abutment, which can be adapted for this purpose.

The needle 11 is provided with geometric means that interact with the body 7 in order to exert a force of holding said needle in a mounting position (FIGS. 6A to 6C) in which said needle projects from the body 7 in order to enable the link 23 to be associated with said needle.

In the embodiment shown, the needle 11 has an intermediate portion on the periphery of which the geometric means are formed in relief in order to interact with at least one contraction 28 formed in the body 7.

More precisely, each flank 11*a*, 11*b* is extended forwards, presenting on its external face a set of vertical ribs 29*a*, 29*b* that are spaced apart longitudinally in order to form between them a housing 30. The body 7 has a contraction 28 that defines the rear opening of the housing 21 in which the needle 11 is mounted, said contraction having on either side a length that is placed in each of the housings 30 in order to hold said needle axially.

In addition, in this embodiment, the intermediate portion has a rectangular cross section that prevents a rotation of the needle 11 with respect to the body 7. Moreover, between the intermediate portion and the closure head 22, the needle 11 has a section in a quadrilateral with three flat edges surmounted by a convex edge, said section being mounted in the skirt of the end piece 20, which has a complementary geometry provided with three knurls 31 placed opposite the flat edges in order to provide the guidance and centring of said head with respect to the ejection orifice 10.

In relation to FIGS. 5A to 5I, a method of assembling the push button is described below, in which the needle 11 is first of all placed in the mounting position. To do this, the needle 11 is introduced into the housing 21 in order to place its rear end in the opening delimited by the contraction 28, and then a pressing-in force is applied to said needle so as to place the surfaces of said contraction in the housings 30, passing said lengths beyond the rear ribs 29*b*. Thus the needle 11 is held axially in a mounting position that is defined, with a sufficient force to enable assembly.

Figure 5A:
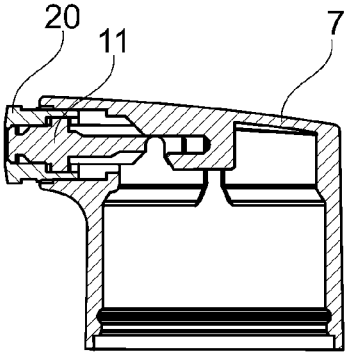
FIGS. 5A to 5I show steps of assembling the push button.
Figure 5B:
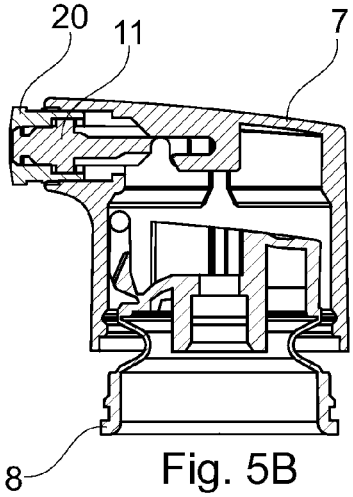
Figure 5C:
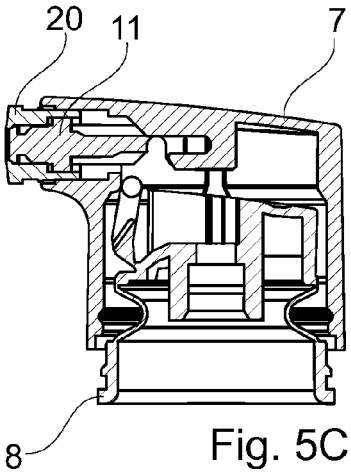
Figure 5D:
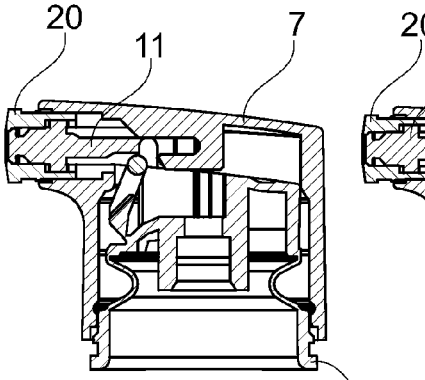

In the embodiment shown, the needle 11 is mounted in the end piece 20 and the assembly consisting of end piece 20 and needle 11 is mounted in the body 7 in the projecting position with the needle 11 in the closure position (FIG. 5A). In particular, in the mounting position, the skirt of the end piece 20 is only partially pressed in the housing 21 of the body 7, while ensuring sufficient holding of the end piece 20 on said body.

Figure 5E:
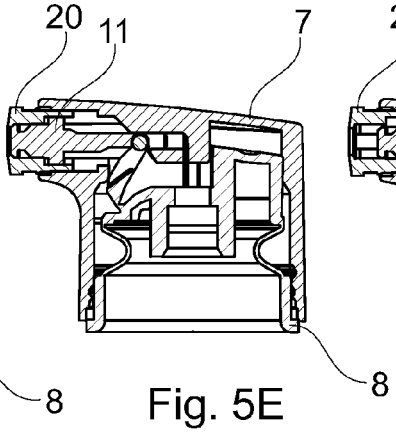
Figure 5F:
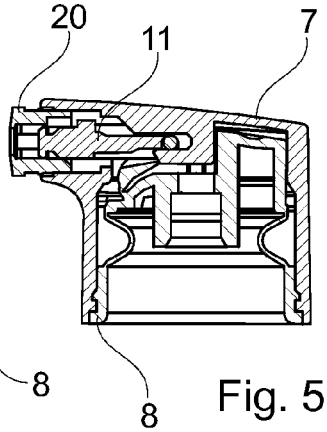
Figure 5G:
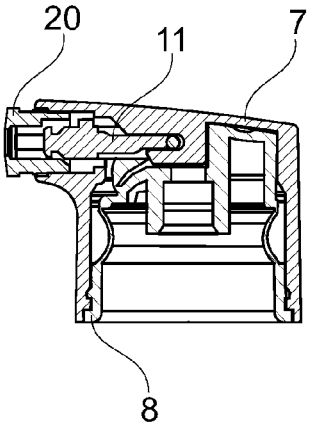
Figure 5H:
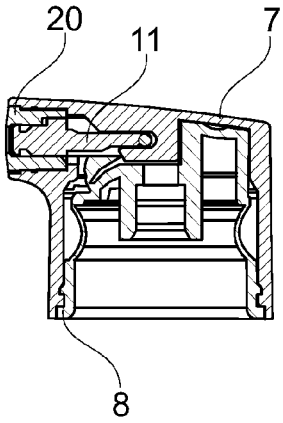
Figure 5I:
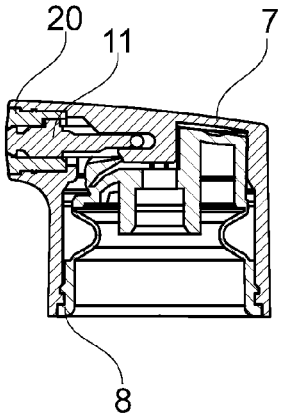

Next the method makes provision for sliding the sleeve 8 in the body 7 (FIGS. 5B to 5D), in particular by pressing on the mounting well 9. The sliding is arranged so as to enable the association of the link 23 with the needle 11 (FIG. 5E). More precisely, the mounting position is defined so that the notch 27 is placed in forward extension of the runner 26*a* so as to enable the spindle 25 of the link 23 to be positioned in said notch.

In addition, the body 7 comprises an internal projection 32 that allows a rearward inclination of the link 23 during sliding (FIGS. 5C and 5D) in order to orient the spindle 25 towards the notch 27. Next the method makes provision for placing the needle 11 in the operational position.

To do this, the embodiment described provides an additional sliding of the sleeve 8 in order to overcome the force of holding the needle 11 in the mounting position, by rearward translational driving of the needle 11 by means of the link 23. In particular, the force exerted by the spindle 25 on the needle 11 enables the surfaces of the contraction 28 to pass beyond the front ribs 29*a* in order to release the translation of said needle. To do this, provision can be made for the sleeve 8 to have means of stiffening the area supporting the link 23, for example formed by a rib 33 placed between the well 9 and the hinge 24 so that said link can transmit the necessary force without bending with respect to said sleeve.

In relation to the figures, the additional sliding is produced after the connection of the collar 14 of the bellows 13 to the body 7 (FIG. 5F), the sliding being continued until the bellows 13 is stretched so as to place the needle 11 in the opening position (FIG. 5G) by rearward translation of the spindle 25 of the link 23 in the runner 26*a*.

Next the end piece 20 is pressed into the housing 21 in the position of use (FIG. 5H) and then the abutment on the mounting well 9 is released so as to allow the elastic return of the bellows 13 with the body 7 in the high position and the needle 11 in the closed position (FIG. 5I), thus putting the push button in the operational state with a view to its mounting on the pump 1.

What is claimed is:

1. A push button for a pressurised-product dispensing system, said push button comprising an actuation body having a product-ejection orifice, a needle closing off the ejection orifice and a sleeve having a well for mounting said push button on a pressurised-product feed tube, said body being mounted so as to slide about said sleeve between a high position and a low position, forming between them a sealed space for conveying the product from said mounting well to said ejection orifice, said needle being associated with the sleeve by a link that is mounted so as to rotate on said sleeve in order to actuate the reversible movement of said needle between a closure position—or respectively an open position—of the ejection orifice when the body is in the high position—or respectively in the low position—, said push button being characterised in that the needle is provided with geometric parts that interact with the body in order to exert a force holding said needle in a mounting position in which said needle projects from the body to enable the link to be associated with said needle.

2. The push button according to claim 1, further comprising a bellows having a top edge secured to the sleeve and a bottom edge secured to the actuation body, said bellows being, by sliding of said body around said sleeve, elastically deformable to a constrained state of return of said body to the high position.

3. The push button according to claim 2, wherein the bellows extends continuously around the mounting well, sealingly delimiting part of the conveying space around said bellows.

4. The push button according to claim 2, wherein the bellows is made in one piece with the sleeve, the bottom edge of said bellows having a collar that is sealingly fixed to the actuation body.

5. The push button according to claim 3, wherein the bellows has a top annular fold that extends internally and a bottom annular fold that extends externally, said folds being movable axially between an initial state and a constrained separated state to allow the return of the actuation body by elastic return of said folds into the initial state.

6. The push button according to claim 2, wherein the bellows is produced from a material with shape memory.

7. The push button according to claim 1, wherein the sleeve comprises a projecting external ring that is mounted in an axial length of the actuation body in order to guide the sliding.

8. The push button according to claim 1, wherein the sleeve has a top external wall that is mounted in an axial length of the body in order to guide the sliding.

9. The push button according to claim 8, wherein the external wall and the axial length of the body have geometric parts for limiting their relative swivelling.

10. The push button according to claim 1, wherein the needle has a front end comprising a closure head, the rear end of said needle having at least one notch for associating said needle on a spindle of said link.

11. The push button according to claim 10 wherein the body comprises a hook forming a runner in which the spindle of the link is mounted so as to be able to move in translation by rotation of said link when said body slides.

12. The push button according to claim 11, wherein the mounting position is defined so that the notch is placed in forward alignment with the runner.

13. The push button according to claim 1, further comprising an end piece that is mounted on the actuation body, said end piece having the ejection orifice and the needle being mounted in translation with respect to said end piece between its closure and opening positions.

14. The push button according to claim 1, wherein the needle has an intermediate portion on the periphery of which the geometric parts are formed in relief in order to interact with at least one contraction formed in the body.

15. The push button according to claim 14, wherein the geometric parts comprise at least one set of ribs forming between them a housing in which a length of the contraction is arranged in order to hold the needle axially.

16. The push button according to claim 1, wherein the sleeve has a part that stiffens the area supporting the link.

17. A method of assembling a push button according to claim 1, said method providing the steps of:

placing the needle in the mounting position;

sliding the sleeve in the body, said sliding being arranged so as to enable the link to be associated with the needle;

placing the needle in the operational position.

18. The assembly method according to claim 17, wherein the placing of the needle in the operational position comprises an additional sliding of the sleeve in order to overcome the force of holding the needle in the mounting position by driving said needle in rearward translation by the link.

19. A pressurised fluid dispensing system comprising a pump actuated by a push button according to claim 1, said pump comprising a pressurised-product feed tube on which the mounting well of said push button is fixed.

20. A bottle containing a product to be dispensed under pressure, said bottle comprising a collar on which a dispensing system according to claim 19 is associated so as to put the pump in communication with a product so as to enable the product to be conveyed from the feed tube to the ejection orifice.

* * * * *